US009027398B2

(12) United States Patent
Ahonen et al.

(10) Patent No.: US 9,027,398 B2
(45) Date of Patent: May 12, 2015

(54) METHOD OF DETECTING WEAR IN A PUMP DRIVEN WITH A FREQUENCY CONVERTER

(75) Inventors: Tero Ahonen, Lappeenranta (FI); Jussi Tamminen, Lappeenranta (FI); Jero Ahola, Lappeenranta (FI)

(73) Assignee: ABB Oy, Helsinki (FI)

( * ) Notice: Subject to any disclaimer, the term of this patent is extended or adjusted under 35 U.S.C. 154(b) by 437 days.

(21) Appl. No.: 13/431,443

(22) Filed: Mar. 27, 2012

(65) Prior Publication Data

US 2012/0247200 A1 Oct. 4, 2012

(30) Foreign Application Priority Data

Mar. 29, 2011 (EP) ..... 11160232

(51) Int. Cl.
*F04D 15/02* (2006.01)

(52) U.S. Cl.
CPC ..... *F04D 15/0272* (2013.01)

(58) Field of Classification Search
CPC ..... F04D 15/0272
USPC ..... 73/168; 417/53, 63
See application file for complete search history.

(56) References Cited

U.S. PATENT DOCUMENTS

| | | | | |
|---|---|---|---|---|
| 6,092,598 | A * | 7/2000 | Breit | 166/250.01 |
| 6,882,960 | B2 * | 4/2005 | Miller | 702/182 |
| 6,918,307 | B2 * | 7/2005 | Ohlsson et al. | 73/861.353 |
| 2004/0120804 | A1 * | 6/2004 | Sabini et al. | 415/118 |
| 2005/0022589 | A1 * | 2/2005 | Du | 73/168 |
| 2007/0212210 | A1 | 9/2007 | Kernan et al. | |
| 2007/0212229 | A1 * | 9/2007 | Stavale et al. | 417/42 |
| 2008/0288115 | A1 | 11/2008 | Rusnak et al. | |
| 2010/0043409 | A1 * | 2/2010 | Naydenov et al. | 60/287 |
| 2012/0141301 | A1 * | 6/2012 | Van Der Spek et al. | 417/53 |

FOREIGN PATENT DOCUMENTS

| | | | |
|---|---|---|---|
| CN | 2336362 | Y | 9/1999 |
| CN | 101203678 | A | 6/2008 |
| DE | 10 2007 009 302 | A1 | 9/2007 |

OTHER PUBLICATIONS

European Search Report issued on Oct. 4, 2011.
First Office Action issued on Mar. 31, 2014, by the Chinese Patent Office in corresponding Chinese Patent Application No. 201210084327.2, and an English Translation of the Office Action. (12 pages).

* cited by examiner

*Primary Examiner* — Hezron E Williams
*Assistant Examiner* — Marrit Eyassu
(74) *Attorney, Agent, or Firm* — Buchanan Ingersoll & Rooney PC

(57) ABSTRACT

A method and an arrangement for detecting wear of a pump are disclosed, which pump is controlled with a frequency converter providing rotational speed and torque estimates, characteristic curves of the pump being known. An exemplary method includes obtaining a value representing the operating point of the pump by measuring the flow ($Q_{act}$) or the head ($H_{act}$) produced by the pump; estimating the operating point of the pump by using a calculation based on the characteristic curves of the pump, the estimated rotational speed ($n_{est}$) of the pump, and the estimated torque ($T_{est}$) of the pump; calculating an estimation error from the value representing the operating point and from the estimated operating point; repeating the above steps during the use of the pump; and detecting the wear of the pump from the amplitude of the estimation error.

16 Claims, 8 Drawing Sheets

METHOD OF DETECTING WEAR IN A PUMP DRIVEN WITH A FREQUENCY CONVERTER

RELATED APPLICATION

This application claims priority under 35 U.S.C. §119 to European Patent Application No. 11160232.2 filed in Europe on Mar. 29, 2011, the entire content of which is hereby incorporated by reference in its entirety.

FIELD

The present disclosure relates to detecting wear of a pump, and for example, to detecting wear of a pump that is controlled with a frequency converter.

BACKGROUND

The efficiency of a centrifugal pump affects the resulting energy and life cycle costs of a pumping system. For this reason, one of the solutions to the energy efficient operation of a pumping system is to maintain the pump in a good mechanical condition, so it could operate at its maximum possible efficiency. This should also ensure that the pump performance (e.g., the produced head H curve as a function of flow rate Q) stays constant.

Over time, the pump efficiency may decrease, for example, because of mechanical wear of the impeller and increased clearances inside the pump (e.g. between the casing and the impeller). In practice, mechanical wear of a centrifugal pump has a decreasing effect on the head H and the flow rate Q that a pump can produce at a constant rotational speed and in constant process conditions (e.g., the pump operating location is changed only because of the changed pump characteristics). Therefore, the wear-related efficiency decrease of a centrifugal pump can be detected by monitoring at least one of these variables in constant process conditions. If the process conditions do not remain constant, the pump operating point location can have several locations, which is why at least two variables should be known to detect the performance decrease in the pump. In the case of variable-speed-driven pumps, the head or flow rate decrease of a centrifugal pump can be compensated by increasing the pump rotational speed, which could also be utilised as a feature of performance decrease in a centrifugal pump.

Known systems for determining wear of a pump include thermodynamic efficiency measurements of the pump, direct measurements of the head, flow rate and shaft power consumption for determining the efficiency of the pump. These known systems can involve shutting the pump and thus the process and/or permanent installations of additional sensors.

SUMMARY

A method is disclosed of detecting wear of a pump, which pump is controlled with a frequency converter providing rotational speed and torque estimates and characteristic curves of the pump being known, the method comprising: obtaining a value representing an operating point of the pump by measuring flow ($Q_{act}$) or head ($H_{act}$) produced by the pump; estimating the operating point of the pump by using a calculation based on characteristic curves of the pump and estimated rotational speed ($n_{est}$) of the pump and estimated torque ($T_{est}$) of the pump; calculating an estimation error from a measured value representing the operating point and from the estimated operating point; repeating the obtaining, estimating and calculating during operation of the pump; and detecting wear of the pump from an amplitude of the estimation error.

An arrangement is also disclosed for detecting wear of a pump controlled with a frequency converter providing rotational speed and torque estimates, characteristic curves of the pump being known, wherein the arrangement comprises: means for obtaining a value representing the operating point of the pump by measuring flow ($Q_{act}$) or head ($H_{act}$) produced by the pump during operation; means for estimating the operating point of the pump with a calculation based on characteristic curves of the pump, estimated rotational speed ($n_{est}$) of the pump, and estimated torque ($T_{est}$) of the pump; means for repeatedly calculating an estimation error from the value representing an operating point and from the estimated operating point during pump operation; and means for detecting pump wear from an amplitude of an estimation error.

BRIEF DESCRIPTION OF THE DRAWINGS

In the following, exemplary embodiments will be described in greater detail with reference to the attached drawings, in which.

DETAILED DESCRIPTION

Figure 1:
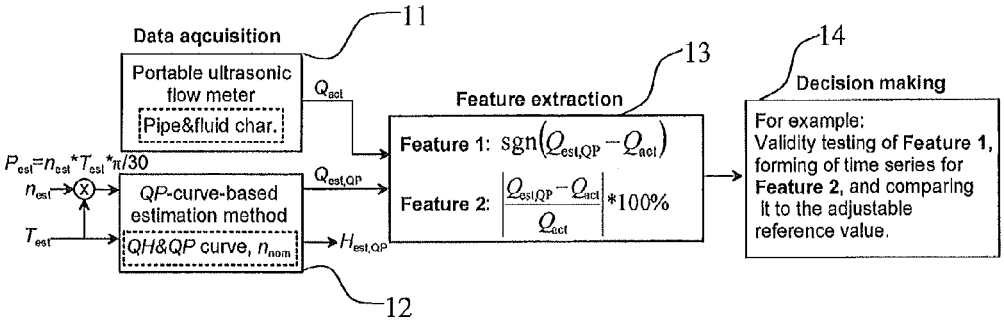
FIG. 1 is a flow diagram of an exemplary embodiment according to the disclosure.

Exemplary embodiments use calculations based on estimates provided by a frequency converter controlling a pump together with characteristic curves provided by a pump manufacturer for estimating flow produced by the pump. Once this value of flow is compared with a flow value obtained through measurement, the amplitude and the sign of the estimation error can give an indication of the wear of the pump.

Since a centrifugal pump operating point location (Q, H) can be estimated by a frequency converter that also provides estimates for the motor-pump combination shaft torque T and rotational speed n, it can be used as a monitoring device or as a source of information for the detection of a performance decrease in a centrifugal pump. Together with an external measurement device for the flow velocity v, flow rate Q, or the head H of the pump, proposed methods allow the detection of a performance decrease in the pump.

Exemplary methods disclosed herein can produce reliable information on the wear of the pump and need not involve any changes or interruptions to the process in which the pump is situated. Further, exemplary methods need not include any additional permanently installed sensors, and can be easy to implement in existing processes.

Exemplary methods disclosed herein are based on an assumption that a wear-related performance decrease in a centrifugal pump affects the QP characteristic curve of the pump. Compared with a normal situation, this can lead to erroneous estimation results for flow rate and head, when the QP curve-based estimation method is applied.

In the case of an increasing QP curve shape (i.e., dP/dQ>0) and a worn pump, the QP estimation method results in lower flow rate values ($Q_{est,QP}$) than they actually are ($Q_{act}$) for a certain rotational speed and shaft power consumption. For this reason, a sign of an estimation error $\mathrm{sgn}(Q_{est,QP}-Q_{act})$ indicates a performance decrease in the pump, which is negative for a worn pump having an increasing QP curve shape. This is used as a first feature (Feature 1) of a performance decrease in a centrifugal pump.

In addition, a magnitude of the estimation error $\Delta Q_{est,QP}$ is proportional to the degree of wear, which is used as a second feature (Feature 2) in the performance decrease detection. The value for the estimation error can be calculated, for instance, with:

$$\Delta Q_{est,QP} = \left|\frac{Q_{est,QP} - Q_{act}}{Q_{act}}\right| \cdot 100\% \tag{1}$$

Concerning the above, it should be noted that the absolute estimation error $|Q_{est,QP}-Q_{act}|$ becomes higher with an increasing flow rate, and the amount of estimation error is also affected by the amount of the actual flow rate $Q_{act}$. For the above reason and according to an exemplary embodiment, the relative estimation error can be used for detecting the wear of the pump.

In order to detect a decrease of performance in the centrifugal pump, a separate reference measurement for the pump flow rate can be installed, if no existing flow rate measurements are available. In this method, a non-intrusive, portable ultrasonic flow rate or flow velocity meter is for example, applied, so the pump flow rate can be detected accurately and without the need of costly sensor installations.

When the actual flow rate values have been measured with the meter during a sufficient time period, these values can be compared with the estimated values to determine the accuracy of the QP curve-based estimation and thus the possible performance decrease in the pump. A flow diagram of an embodiment of the method is shown in FIG. 1.

In the embodiment shown in FIG. 1, data is gathered using a flow meter and a frequency converter. The flow meter is used for measuring the value of flow $Q_{act}$ (11), and the frequency converter provides estimates for rotational speed and torque of the pump. Rotational speed and torque are used for calculating the power P which is used together with the QP curve for obtaining an estimate of the flow $Q_{est,QP}$ (12). In the feature extraction block 13 (e.g., a processor and/or program module configured as or with software and/or hardware programming in accordance with the present disclosure), the sign of the error is determined and the relative estimation error is calculated. These indicators are used in the decision-making block 14 (e.g., a processor and/or program modules, separate or combined with other processors, configured as or with software and/or hardware programming in accordance with the present disclosure) for determining and/or detecting, whether the pump has worn. The relative estimation error can be compared to a reference value, or the trend of the estimation error can be followed. If the estimation error grows with time, it can be considered that the pump is clearly worn.

An Increasing QP curve shape can be common in the radial and mixed-flow pumps. If the pump QP curve is monotonically decreasing (i.e. dP/dQ<0), then the estimated flow rate $Q_{est,QP}$ becomes higher than $Q_{act}$, due to the change of the pump characteristic curves.

The above measurement should be carried out regularly to see the possible change in the pump performance. A calibration measurement sequence is also recommended before the actual use of the method, since the actual characteristic curves of a brand new centrifugal pump may notably differ from the published ones.

For the sake of simplicity, there should be an automatic synchronisation, such as time stamping, of the measured and estimated flow rate values between the frequency converter and the flow meter. Correspondingly, the use of a wireless communication link between the converter and the meter could make the method more practicable.

In the following sections, exemplary portions of the method are explained in more detail. Test results are also given for a radial flow centrifugal pump in two different cases with a decreased performance.

Figure 2:
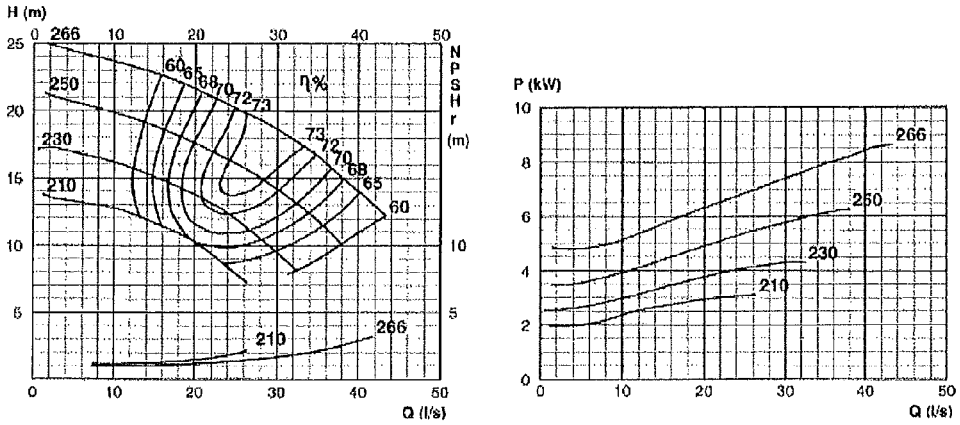
FIG. 2 shows published characteristic curves of a Sulzer APP22-80 centrifugal pump.

The characteristics and general performance of a centrifugal pump can be visualised by characteristic curves for the head H, shaft power consumption P and efficiency η as a function of flow rate Q at a constant rotational speed. They also inform the best efficiency point (BEP) of a centrifugal pump, at which the pump should be driven. In FIG. 2, an example of the published characteristic curves for a Sulzer APP22-80 radial flow centrifugal pump is given.

As a frequency converter-driven pump can be operated at various rotational speeds, the pump characteristic curves can be converted into the current rotational speed. This can be performed by utilising affinity laws:

$$Q = \frac{n}{n_0} Q_0 \tag{2}$$

$$H = \left(\frac{n}{n_0}\right)^2 H_0 \tag{3}$$

$$P = \left(\frac{n}{n_0}\right)^3 P_0 \tag{4}$$

where Q is the flow rate, H is the pump head, P is the pump shaft power consumption, n is the rotational speed, and the subscript $_0$ denotes the initial values given in the published characteristic curves, for instance.

Figure 3:
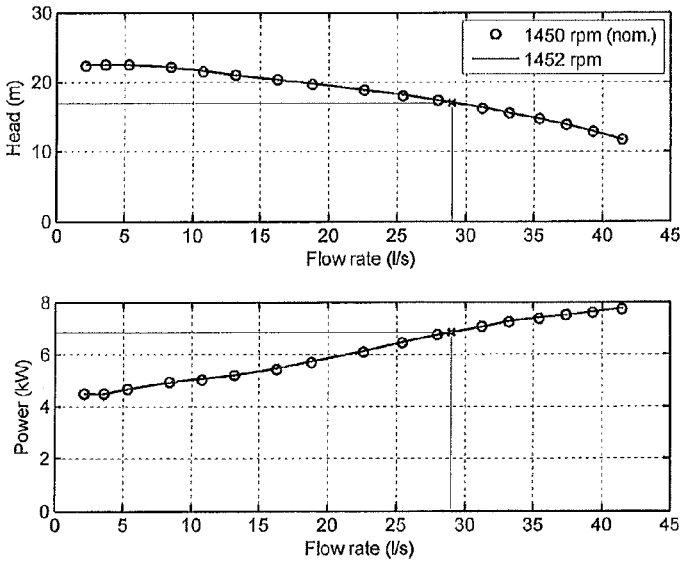
FIG. 3 exemplifies pump operating point estimation.

Pump characteristic curves allow the sensorless estimation of the pump operating point location and efficiency by utilising the rotational speed, shaft torque and resulting shaft power estimates ($n_{est}$, $T_{est}$ and $P_{est}$, respectively) provided by a frequency converter, as shown in FIG. 3. This model-based estimation method for the pump operating location is well-known and is called the QP curve-based estimation later in this document.

The flow rate produced by the pump can be measured with a portable and non-intrusive flow meter. This can be done with an ultrasonic flow meter that is based on measuring the flow velocity either by utilising the Doppler effect of a moving liquid or by determining the propagation of the transit time between two measurement points. The transit-time meters can provide good accuracy, but they are also more expensive than the Doppler effect and can involve the installation of sensors around the pipe with several chains.

There are two exemplary basic wear mechanisms in centrifugal pumps: 1) The impeller blade tips may wear, which reduces the effective pump diameter; 2) The internal clearance s between the impeller and suction side of the pump may increase from its original value. In the case of diameter-reducing wear, the resulting pump performance can be partially approximated with the characteristic curves for several different impeller diameters. As an example, FIG. 2 shows how the pump head and power consumption decrease at the constant flow rates because of the smaller impeller diameter.

If the pump is equipped with an open impeller, the effect of a change of internal clearance s on the pump head can be approximated with the equation:

$$\frac{H_{(s=0)} - H_{(s)}}{H_{(s=0)}} = f \cdot s \tag{5}$$

where f is a case-specific gradient value describing the effect of clearance on the developed pump head. The head loss also has a decreasing effect on the pump power consumption P and efficiency, as shown by equations:

$$\frac{P_{(s=0)} - P_{(s)}}{P_{(s=0)}} = \frac{1}{3}\frac{H_{(s=0)} - H_{(s)}}{H_{(s=0)}} \tag{6}$$

$$\frac{\eta_{(s=0)} - \eta_{(s)}}{\eta_{(s=0)}} = \frac{2}{3}\frac{H_{(s=0)} - H_{(s)}}{H_{(s=0)}} \tag{7}$$

Figure 4:
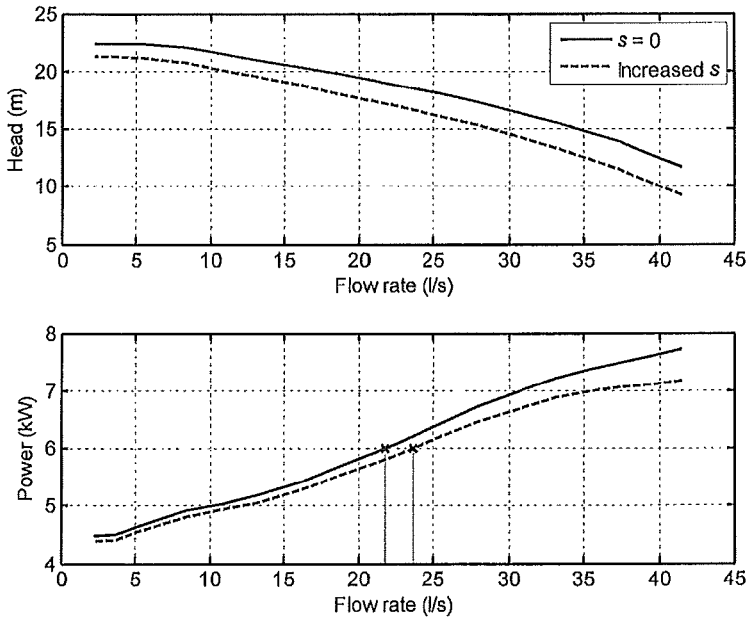
FIGS. 4 and 5 show examples of a clearance-related head decrease on pump characteristic curves.

In addition, it is known that the relative impairment of the pump head is proportional to the flow rate. For this reason, the shut-off head drops approximately half as much as the head at the best efficiency point. Consequently, a best efficiency point is shifted towards lower flow rates with an increasing clearance. FIG. 4 shows an example of how the pump characteristic curves may be altered because of the increased clearance s, when there is a decrease of 1 meter in the pump shut-off head (e.g., the head at a zero flow rate), and the head decrease increases linearly with the flow rate being 2 meter at the pump BEP.

In practice, the performance decrease of the pump may also be visible in the rotational speed of the pump. If the pump is a part of the closed-loop system, in which the process QH curve stays constant, internal wear of the pump reduces the pump flow rate at a constant rotational speed. For instance in FIG. 4, the flow rate may decrease from 25 l/s to 23.79 l/s at 1450 rpm. If it is known that the pumping system has constant process characteristics, the long-term (statistical) monitoring of rotational speed may also be an applicable method for detecting a performance decrease in the pump.

The proposed pump wear detection method was evaluated by utilising data collected with laboratory measurements. Laboratory measurements were conducted with a Sulzer APP 22-80 centrifugal pump, an ABB 11 kW induction motor, and an ABB ACS 800 series frequency converter. The pump has a radial flow impeller with a 255 mm impeller, and the internal clearance between the impeller and suction side of the pump can be adjusted without opening the pump. The motor and the pump are connected to each other by a Dataflex 22/100 speed and torque measurement shaft, which has a torque measurement accuracy of 1 Nm. The pump operating point location was determined with Wika absolute pressure sensors for the head and a pressure difference sensor across the venture tube, which equals the pump flow rate. In addition, a portable ultrasonic flow meter (Omega FD613) was used in the measurements, and its accuracy was verified to be applicable to the measurement of the actual flow rate.

The pump is located in a process, which includes (e.g., consists of) two water containers, valves, and alternative pipe lines. The shape of the process characteristic curve and the resulting operating point location can be modified by adjusting the valves in the pipe lines.

Figure 5:
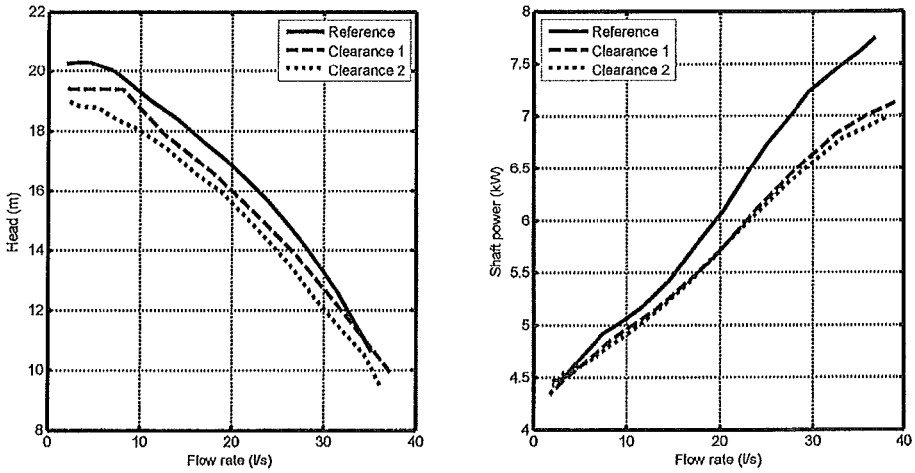

In the first test sequence, the clearance of the pump was increased from an exemplary nominal clearance of 0.5 mm to a clearance of 1.5 mm (Clearance 1) to 1.9 mm (Clearance 2). The effects of the change in clearance can be seen in FIG. 5.

Figure 6:
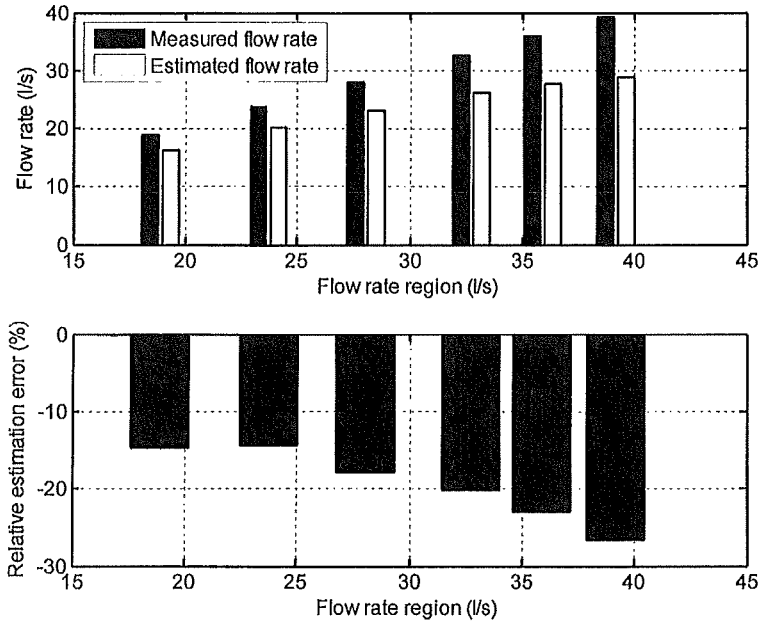
FIGS. 6 and 7 show an effect of clearance on an estimation accuracy of flow rate.

The measurement series were carried out for the different clearances and the functionality of the method was examined. In FIG. 6, the proposed method was examined for the 1.5 mm clearance. The QP curve-based estimation method estimates the flow rate to be over 10% less than the measured flow rate, which would indicate that the wear of a pump affects the accuracy of the estimation method as previously suggested. The estimation error ranges from −15 to −26% and the relative magnitude of error increases with an increasing flow rate, as expected.

Figure 7:
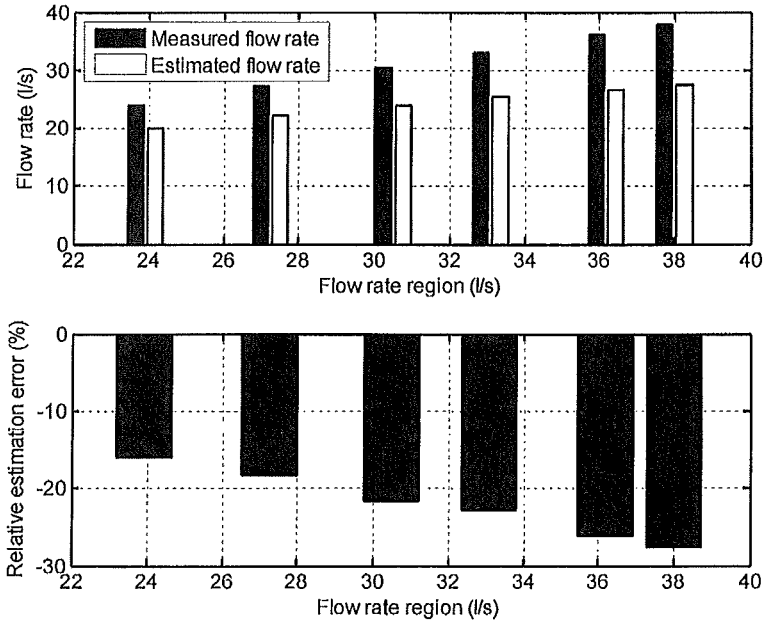

The measurements series for the 1.9 mm clearance is illustrated in FIG. 7. The relative estimation error for the flow rates ranges from −16 to −28% and the error increases as a function of flow rate. There is no significant difference between the results of FIG. 6 and FIG. 7, but in both cases the performance decrease of the pump leads to erroneous estimation results.

In the second test sequence, outlet blades of the pump impeller were gradually ground in order to reduce the pump performance similarly as by decreasing the effective impeller diameter. Several measurement sequences were carried out after each grinding stage. A measurement sequence was carried out with the ground impeller, and results where a decrease in the pump performance was reliably detected were compared with the original situation. It should be noted that this test emulates incipient wear of the blades, because the effective diameter has decreased only at the top of the outlet blade. In addition, grinding may have actually improved the quality of the impeller surface (e.g., smoothed the surface roughness), partially compensating for the effect of wear on the blade edges.

Figure 8:
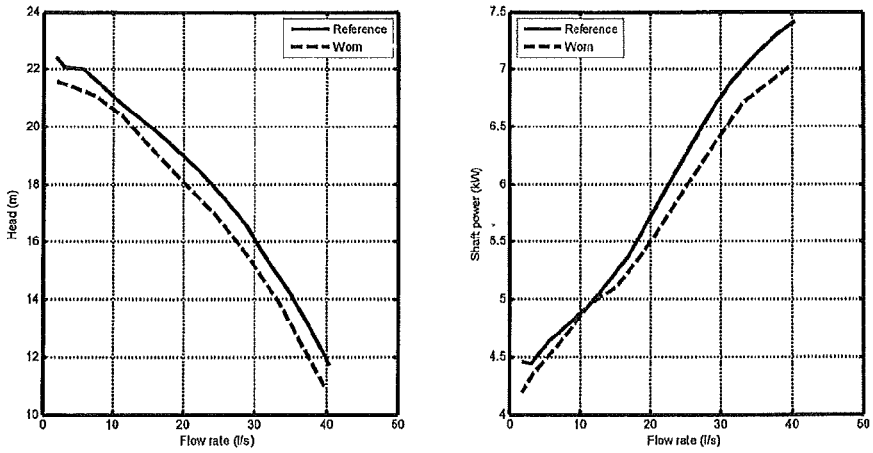
FIG. 8 shows exemplary characteristic curves of a pump having worn impeller blades compared with a reference case of a pump having an unworn impeller.

Firstly, the pump characteristic curves were measured at a rotational speed of 1450 rpm, and they are shown together with the previously measured (Reference) characteristic curves in FIG. 8. It can be seen in FIG. 8 that incipient wear reduces the pump output and pump shaft power, as suggested by FIG. 2.

Figure 9:
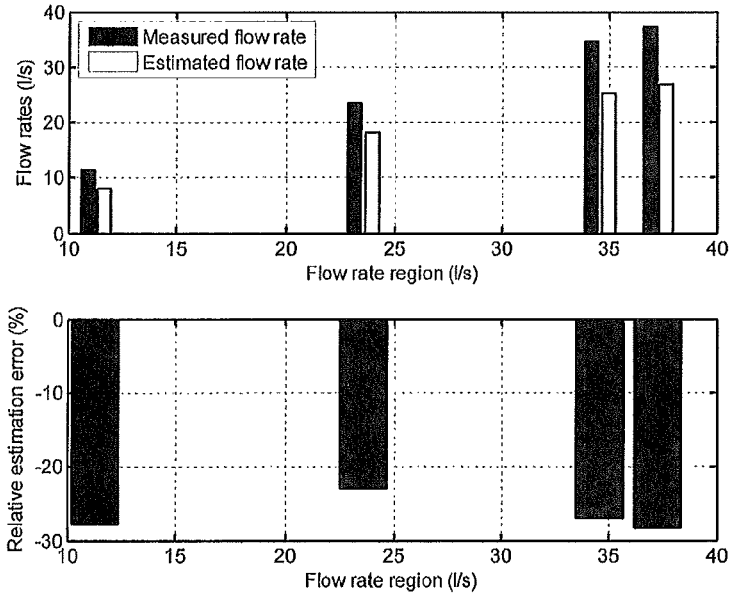
FIGS. 9, 10 and 11 show exemplary results in worn impeller blade tests.

The operation of the pump with worn impellers was measured with four specific valve settings and at three rotational speeds (1380, 1452 and 1500 rpm). The error produced in the QP curve-based estimation method for the series with the 1380 rpm rotational speed is given in FIG. 9. The relative error ranges from −22 to −28%.

Figure 10:
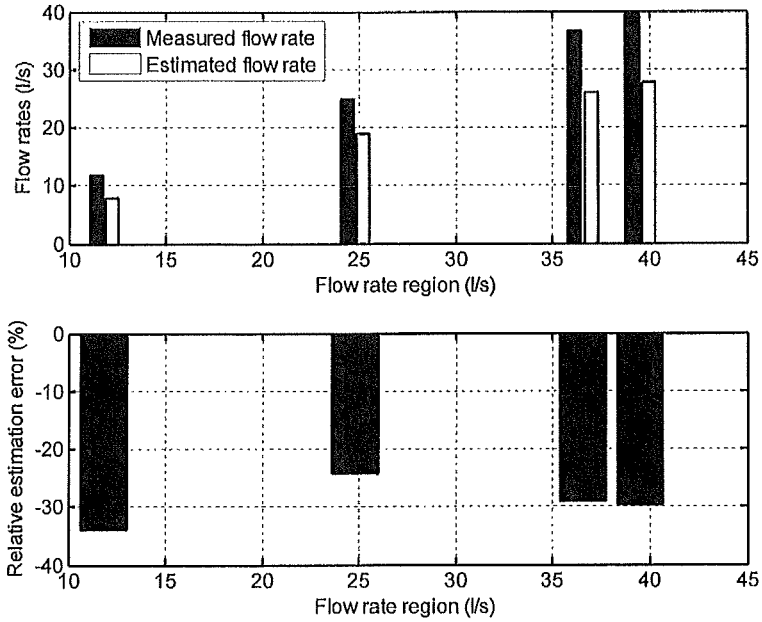

A measurement series with the rotational speed of 1452 rpm was also carried out using the same valve settings. The estimation results are shown in FIG. 10, and they are similar to the previously shown results.

Figure 11:
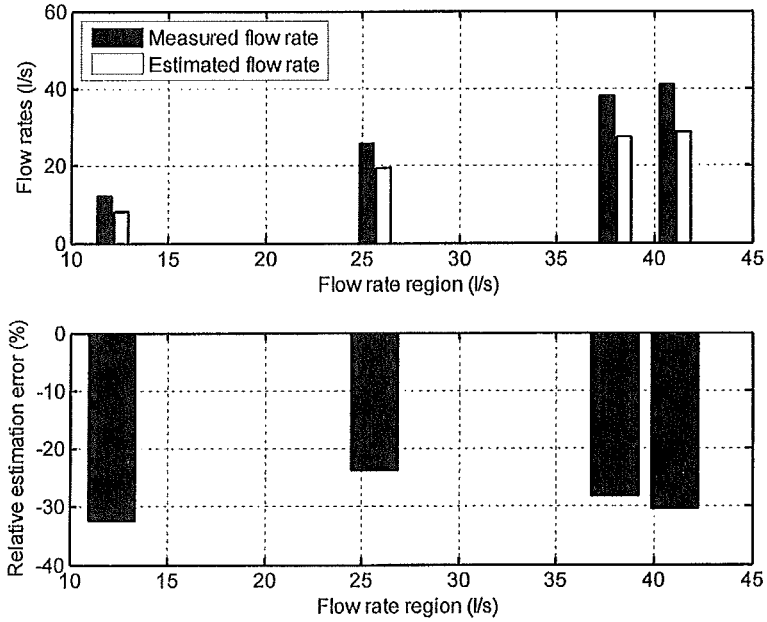

The rotational speed of 1500 rpm in FIG. 11 gives the same results as the previously introduced measurement series at lower rotational speeds. The QP curve-based estimation method produces estimates that are more than 20% lower than the measured flow rate. The relative estimation error is from −24 to −32%.

If there is pressure difference measurement available across the pump, the pump head can be determined accurately. This also allows the use of the QH curve-based calculation method for the pump flow rate estimation. In addition, the head measurements also allow the detection of pump wear by several alternative means. All of these can rely on the development of wear affecting the characteristic curves of the pump (i.e., QP and QH curves). In the following sections, examples are given how the head measurement could be utilised in the wear detection.

A well-known, and reliable method for detecting pump wear is to run the pump against a closed valve. In this case the pump produces a head equal to its shut-off head. The pump can be said to be worn, if the pump shut-off head drops in time compared to the control measurements carried out during the pump deployment. This method involves the use of the pump against a closed valve, which is not a normal operating point for a pump and involves some additional operation of the maintenance crew, like shutting the valve, for instance.

Figure 12:
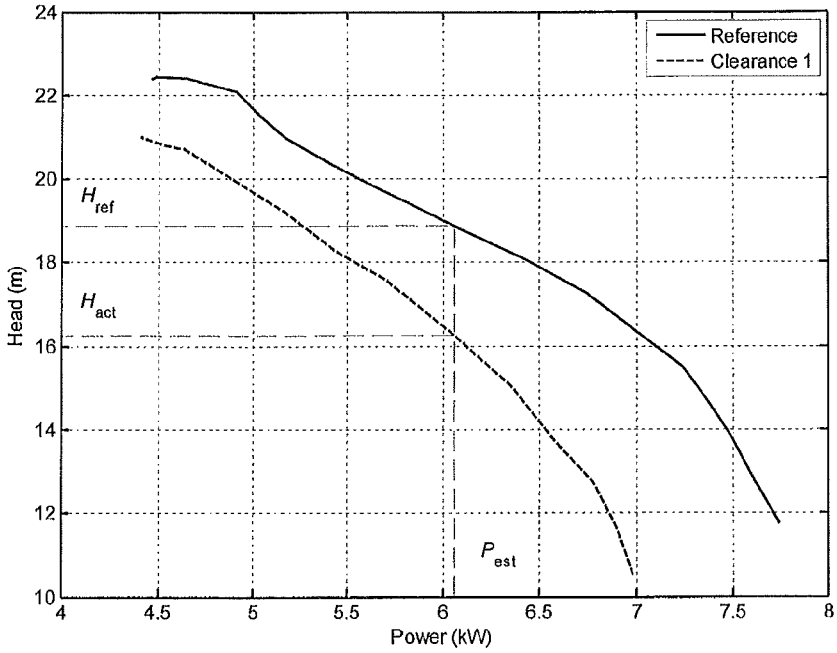
FIG. 12 shows an example of effect of wear in a pump PH curve.

A pump power to head curve (PH curve) can be formed from the known pump characteristic curve points. The PH curve can also be formed from the head measurement and power estimate over some time period. When the pump wears down, the head to power curve starts to decrease, so there will be a difference between the original and the present PH curves. An example case of this is given in FIG. 12, where the measurement data from the increased clearance case is used. As it can be seen in FIG. 12, the power to head curve has a static drop compared with the reference situation. Depending on the amount of static drop and its time trend, it can be determined whether the pump has worn and should be repaired. In FIG. 12, the 6.06 kW power gives a measured head $H_{act}$ of 16.3 m, but the reference curve indicates that the produced head should be 18.9 m (denoted by $H_{ref}$ in the figure). Hence, if the measured head is smaller than the estimated head from the PH curve, the pump can be said to be worn.

Figure 13:
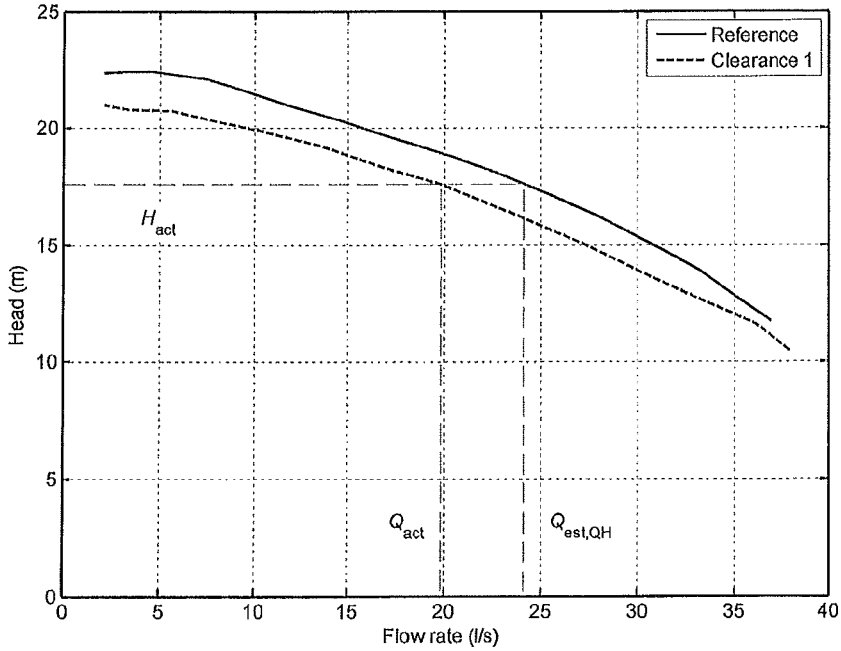
FIG. 13 shows an example of effect of wear in a pump QH curve.

There are two well-known estimation methods for the pump operating point location (Q and H): the QP curve-based method and the QH curve-based estimation method, in which the pump operating point is estimated with the measured head and the pump QH characteristic curve. In both estimation methods, a worn pump produces an increased estimation error compared with the original 'healthy' situation. With the QP curve estimation method, the flow rate estimation gives flow rates lower than the real flow rate, as explained before. Correspondingly, the QH curve-based method gives higher flow rates compared to the real flow rate. Hence, the wear of the pump can be detected by monitoring the following features:

1) The sign of the difference of the flow rates produced by QP and QH estimation methods $\mathrm{sgn}(Q_{est,QP}-Q_{est,QH})$ should be negative;
2) The magnitude (e.g. the time series behaviour or trend) of the relative estimation error describes the degree or development of the wear. The magnitude of the relative estimation error can be calculated, for instance, with:

$$\left|\frac{Q_{est,QP}-Q_{est,QH}}{Q_{act}}\right|\cdot 100\% \tag{8}$$

when the actual flow rate is known. An example of this is given in FIG. 13 and FIG. 14. In FIG. 13, the real flow rate $Q_{act}$ in the worn pump is 19.8 l/s, and the pump produces a head of 17.6 m. With this head, the QH estimation method estimates the flow rate 0 to be 24.1 l/s, which is notably higher than the real flow rate value of 19.8 l/s.

Figure 14:
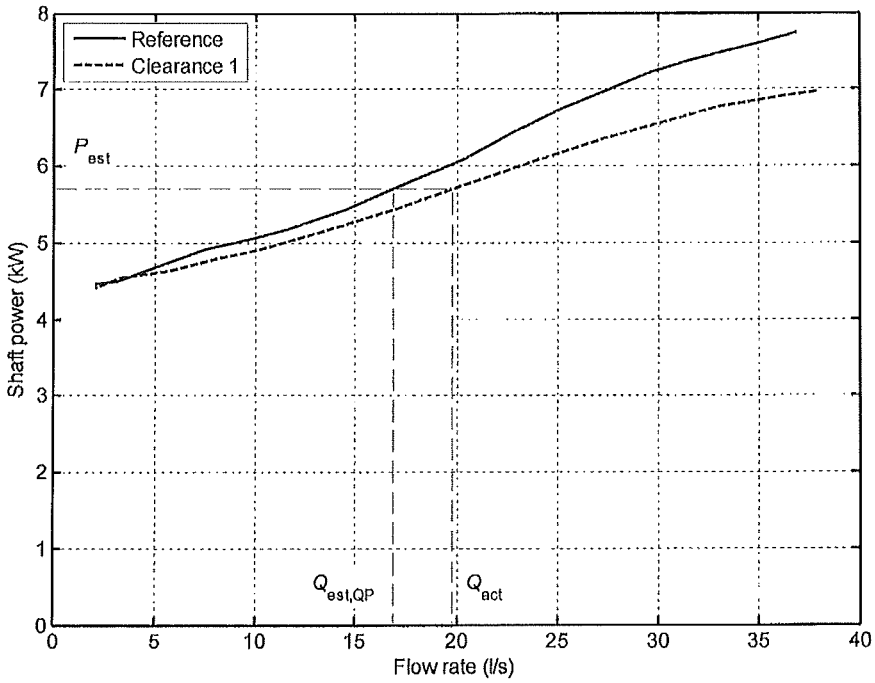
FIG. 14 shows an example of effect of wear in a pump QP curve.

FIG. 14 shows that, with the same real flow rate $Q_{act}$ of 19.8 l/s, the estimated power consumption $P_{est}$ of a worn pump is 5.7 kW. In the QP curve-based estimation, the estimated power and the given reference curves give an estimate of 16.9 l/s for the flow rate $Q_{est,QP}$, which is notably lower than the real flow rate $Q_{act}$ of 19.8 l/s.

Thus, assuming that both estimation results correspond to each other at the beginning of the pump lifetime, and over time the estimates start to drift apart, it can be said that the pump is becoming worn. This example shows that, with an increased clearance, the difference of the estimation methods should become notable, as the $Q_{est,QH}$ is 24.1 l/s and $Q_{est,QP}$ is 16.9 l/s.

Figure 15:
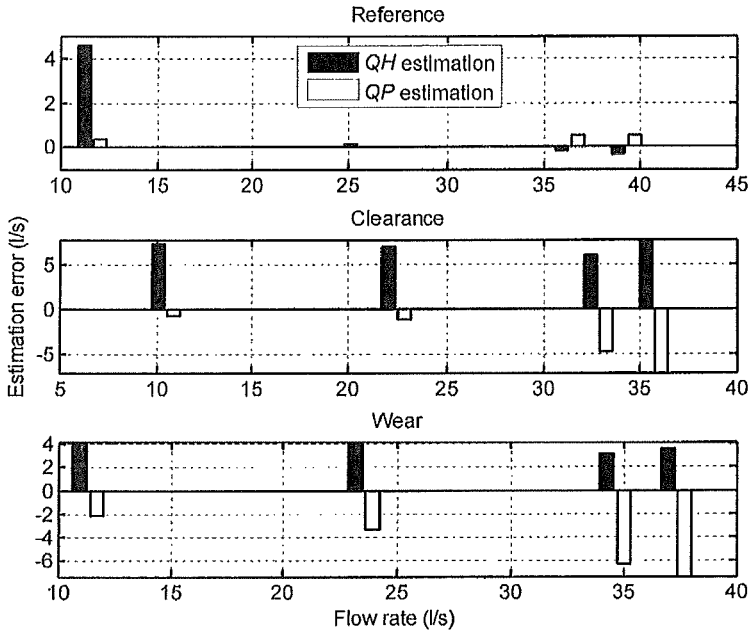
FIGS. 15, 16 and 17 show exemplary estimation errors at three different rotational speeds.

The proposed difference method was evaluated with the same measurements as the previously proposed method. The estimation errors at the rotational speed of 1380 rpm with different valve settings are given in FIG. 15. The flow rate estimations for the reference measurements (see subfigure Reference) are within ±1 l/s of the real flow rate with one exception: in one of the cases the estimation error is 4 l/s, which is probably caused by a measurement error. In the case, where the clearance of the pump is increased (subfigure Clearance), the flow rate estimation error of the QH curve-based estimation method has increased significantly to 6-8 l/s, and the estimation error of the QP-curve-based method is between −1 and −7 l/s. In the case where the impeller was ground (sub-figure Wear), the QH curve-based estimation error is between 3 and 4.5 l/s, and for the QP curve-based method the estimation error is between −2 and −8 l/s, respectively.

Figure 16:
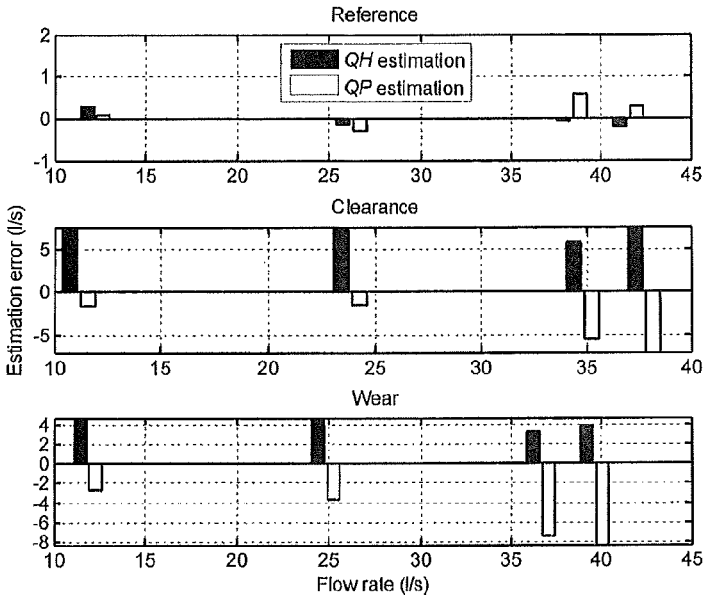
Figure 17:
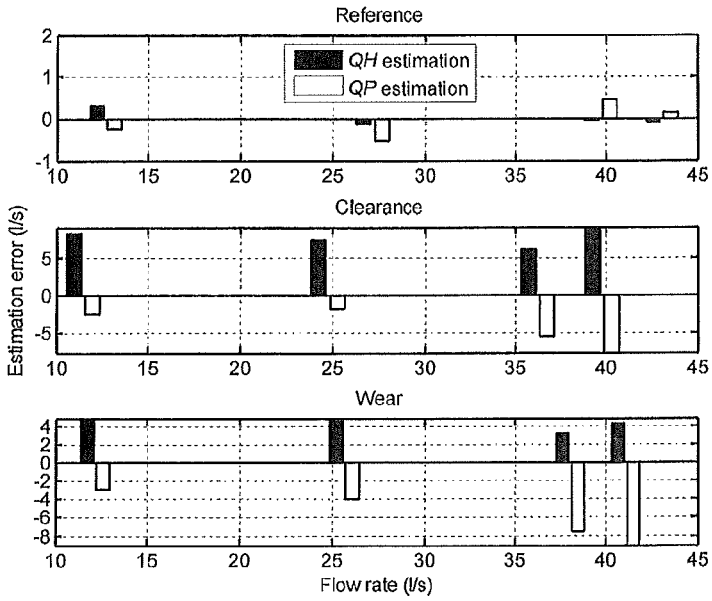

The estimation errors for the measurement series with different valve settings at the rotational speed of 1450 rpm are given in FIG. 16. Again, the flow rate estimation error for a reference measurement series is within −1 . . . 1 l/s. The flow rate error in the QH curve-based estimation is between 5 to 8 l/s and 3 to 5 l/s for the clearance and wear measurement series, respectively. For the QP curve-based estimation methods, the estimation errors are between −2 . . . −7 l/s and −2 . . . −8 l/s for the clearance and wear measurement series, respectively.

For the measurements at 1500 rpm, the estimation errors for the reference measurement series are all within −1 . . . 1 l/s. In the case of the increased clearance, the flow rate error of the QH curve-based estimation method is 6 to 9 l/s and the QP curve-based method estimation error is −2 . . . −8 l/s. In the case, where the impeller was gradually ground, the QH curve-based estimation error is 3 to 4 l/s, and for the QP-curve-based estimation error −3 . . . −9 l/s, respectively.

The measurement results show that, with each valve setting and each rotational speed, the QH curve-based flow rate estimation gives higher flow rate values than the real flow rate.

Correspondingly, the QP curve-based method gives too low flow rate estimates as expected. Thus, the difference in the estimations and the drift in time indicate pump wear.

Each presented embodiment can be used in a specific type of pump operating situation. A few examples are given in the following cases.

When no additional measurement is attached to the pumping system, then the pump wear detection should be conducted using the QP curve-based estimation method and a portable flow measurement sensor, such as an ultrasonic flow meter. The flow measurements should be conducted several times over some period of time. An indication of wear is seen, when the absolute value of the estimation error increases over time and the error sign of the error is negative. So the detection is performed by monitoring the amplitude and direction of the estimation error.

The QH curve-based in combination with the QP curve-based method is utilised, if the pumping system has a head measurement. The QP curve-based method is used, when the measurement is a flow measurement. Again, the time domain behaviour of the error in the estimation is utilised, meaning the amplitude of the error and its direction.

When the head is measured, then the QP curve-based method should estimate the flow rate lower than in the QH curve-based method. Since the absolute value of this difference increases over time in the direction indicated previously, it can be interpreted as a sign of wear.

When a permanent flow rate measurement is applied, the wear detection is performed in the same way as with a portable measurement device, but continuously. The direction and amplitude of the estimation error in the QP curve-based method are monitored and the wear is detected from that error.

The conducted measurements indicate that the estimation error of model-based methods for the pump flow rate can be used to detect wear in a centrifugal pump. Exemplary methods as disclosed herein can detect both the increase of clearance and the blade wear. Depending on the available measurements, the performance reducing wear can be detected either with a QP curve-based estimation method and a flow rate measurement, with the combination of a head measurement and a shaft power estimate or with the combination of a QH and a QP curve-based estimation method.

It will be apparent to a person skilled in the art that, as technology advances, the inventive concepts disclosed herein can be implemented in various ways. The invention and its embodiments are not limited to the examples described above but may vary within the scope of the claims.

Thus, It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A method of detecting wear of a pump, which pump is controlled with a frequency converter providing rotational speed and torque estimates, and characteristic curves of the pump being known, the method comprising:

obtaining a value representing an operating point of the pump by measuring flow ($Q_{act}$) or head ($H_{act}$) produced by the pump;

estimating, in a processor, the operating point of the pump by using a calculation based on characteristic curves of the pump and estimated rotational speed ($n_{est}$) of the pump and estimated torque ($T_{est}$) of the pump;

calculating, in the processor, an estimation error from a measured value representing the operating point and from the estimated operating point;

repeating the obtaining, estimating and calculating during operation of the pump; and detecting, in the processor, wear of the pump from an amplitude of the estimation error.

2. A method according to claim 1, wherein the obtaining of a value representing the operating point of the pump comprises:

obtaining a value, using a QH curve of the pump, representing flow ($Q_{est,QH}$) when the head produced by the pump is measured.

3. A method according to claim 2, comprising:

estimating, in the processor, a flow ($Q_{est,QP}$) produced by the pump by using a QP curve-based estimation, the rotational speed, and torque estimates provided by the frequency converter, wherein the calculating of the estimation error comprises:

calculating, in the processor, a relative estimation error of the flow and a sign of the error, and wherein the detecting of the wear comprises:

detecting, in the processor, the wear of the pump from an amplitude of the relative estimation and from a sign of the estimation error.

4. A method according to claim 3, comprising:

detecting the wear of the pump when the sign of the estimation error stays the same in repeated measurements and the amplitude of the relative estimation error grows gradually in repeated measurements.

5. A method according to claim 1, wherein the obtaining a value representing the operating point of the pump comprises:

using the measured flow as a value representing the operating point.

6. A method according to claim 5, comprising:

measuring the flow produced by the pump with a portable measuring device.

7. A method according to claim 5, comprising:

estimating, in the processor, a flow ($Q_{est,QP}$) produced by the pump by using a QP curve-based estimation, the rotational speed, and torque estimates provided by the frequency converter, wherein the calculating of the estimation error comprises:

calculating, in the processor, a relative estimation error of the flow and a sign of the error, and wherein the detecting of the wear comprises:

detecting, in the processor, the wear of the pump from an amplitude of the relative estimation and from a sign of the estimation error.

8. A method according to claim 7, comprising:

detecting the wear of the pump when the sign of the estimation error stays the same in repeated measurements and the amplitude of the relative estimation error grows gradually in repeated measurements.

9. A method according to claim 8, comprising:

measuring the flow produced by the pump with a portable measuring device.

10. A method according to claim 1, wherein the obtaining of a value representing the operating point of the pump comprises:

using the measured head as a value representing the operating point, and wherein the estimating of the operating point of the pump comprises:

estimating the head of the pump by using estimated power calculated from the estimated rotational speed, and estimated torque and a PH curve of the pump, and the calculating the estimation error comprises:

calculating the estimation error between the estimated head and the measured head.

11. An arrangement for detecting wear of a pump controlled with a frequency converter providing rotational speed and torque estimates, characteristic curves of the pump being known, wherein the arrangement comprises:

means for obtaining a value representing an operating point of the pump by measuring flow ($Q_{act}$) or head ($H_{act}$) produced by the pump during operation; and processing means for estimating the operating point of the pump with a calculation based on characteristic curves of the pump, estimated rotational speed ($n_{est}$) of the pump, and estimated torque ($T_{est}$) of the pump, repeatedly calculating an estimation error from the value representing the operating point and from the estimated operating point during pump operation, and detecting pump wear from an amplitude of an estimation error.

12. The arrangement of claim 11, wherein the processing means provides an indication of pump wear.

13. The arrangement of claim 11, wherein the obtaining means includes a flow meter.

14. The arrangement of claim 11, in combination with a pump whose wear is to be detected and a frequency converter.

15. The arrangement of claim 14, wherein the frequency converter is connected with the detecting means via a wireless communication link.

16. The arrangement of claim 11, wherein the processing means includes a processor configured with program modules to perform the estimating, calculating, and detecting wherein the processor is connected with the obtaining means.

* * * * *